US008104762B2

(12) United States Patent
Nakashima et al.

(10) Patent No.: US 8,104,762 B2
(45) Date of Patent: Jan. 31, 2012

(54) FEEDING DEVICE WITH FEEDING ROLLER AND TRANSPORT ROLLERS

(75) Inventors: Hiroki Nakashima, Matsumoto (JP); Masamitsu Shimazu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 395 days.

(21) Appl. No.: 11/763,970

(22) Filed: Jun. 15, 2007

(65) Prior Publication Data

US 2007/0290429 A1 Dec. 20, 2007

(30) Foreign Application Priority Data

Jun. 15, 2006 (JP) ..... 2006-166572

(51) Int. Cl.
*B65H 5/00* (2006.01)

(52) U.S. Cl. ..... 271/10.11; 271/10.12; 271/242

(58) Field of Classification Search ..... 271/10.01, 271/10.11–10.13, 242, 121, 122
See application file for complete search history.

(56) References Cited

U.S. PATENT DOCUMENTS

| | | | | |
|---|---|---|---|---|
| 4,589,650 | A * | 5/1986 | Miyoshi | 271/242 |
| 5,022,642 | A * | 6/1991 | Hasegawa et al. | 271/10.12 |
| 5,326,091 | A * | 7/1994 | Giacometto et al. | 271/10.01 |
| 5,415,387 | A * | 5/1995 | Suzuki | 271/10.02 |
| 5,927,703 | A * | 7/1999 | Endo | 271/10.03 |
| 6,079,708 | A * | 6/2000 | Fujita | 271/242 |
| 6,158,733 | A * | 12/2000 | Muraki | 271/127 |
| 6,565,077 | B2 * | 5/2003 | Kawada | 271/10.03 |
| 7,874,555 | B2 * | 1/2011 | Nakashima | 271/9.12 |

FOREIGN PATENT DOCUMENTS

| | | |
|---|---|---|
| JP | 04-064554 | 2/1992 |
| JP | 08-081091 | 3/1996 |
| JP | 10-152243 | 6/1998 |
| JP | 11-309935 | 11/1999 |
| JP | 2000-318881 | 11/2000 |
| JP | 2001-097578 | 4/2001 |
| JP | 2001-097599 | 4/2001 |

* cited by examiner

*Primary Examiner* — Jeremy R Severson
(74) *Attorney, Agent, or Firm* — Maschoff Gilmore & Israelsen

(57) ABSTRACT

A feeding device includes a feeding roller and a pair of transport rollers. The feeding roller picks up stacked recording medium and feeds the recording medium downstream direction. The pair of transport rollers transport the fed recording medium to a recording section. The feeding roller is provided so as to be capable of contacting a separating unit that separates the overlapped recording medium with plural. Between a contact point of the feeding roller and the separating unit and a nip point of the pair of transport rollers, a first tangent line does not intersect a second tangent line. The first tangent line is situated at the contact point of the feeding roller and the separating unit. The second tangent line is situated at the nip point of the pair of transport rollers.

3 Claims, 5 Drawing Sheets

FEEDING DEVICE WITH FEEDING ROLLER AND TRANSPORT ROLLERS

BACKGROUND

1. Technical Field

The present invention relates to a feeding device including a feeding roller (which picks up stacked recording medium and feeds them downstream) and a pair of transport rollers (which transport the fed recording medium to a recording section), and to a recording apparatus and to a liquid ejecting apparatus including the feeding device.

Here, "liquid ejecting apparatus" not only refers to recording apparatuses, such as a facsimile, a copying machine, and an ink jet recording apparatus performing recording on a recording medium, such as a recording sheet, by ejecting ink onto the recording medium from a recording head serving as a liquid ejecting head, but also to an apparatus that adheres a liquid to an ejection medium (corresponding to the recording medium) by ejecting to the ejection medium a particular-purpose liquid instead of ink from a liquid ejecting head (corresponding to the aforementioned recording head). Examples of liquid ejecting heads include, in addition to the recording head, a color-material ejecting head used in producing a color filter of, for example, a liquid crystal display; an electrode-material (conductive paste) ejecting head used for forming electrodes in, for example, an organic EL display or a surface emitting display (FED); a bioorganic material ejecting head used for producing a bio-chip; and a sample ejecting head, serving as a precision pippet, that ejects a sample.

2. Related Art

As discussed in JP-A-2000-318881, a related feeding device includes a hopper, where sheets are stacked; a feeding roller that picks up the topmost sheet among the stacked sheets and feeds it downstream; and a pair of transport rollers that transport the fed sheet to a recording section. More specifically, the hopper is provided so that its upper portion swings on a fulcrum and so that it moves into contact with and separates from the feeding roller. In addition, the hopper is provided so that, when it moves close to the feeding roller, the feeding roller rotates and picks up the topmost sheet. Further, the hopper is provided so that, even when a plurality of sheets are picked up, the sheets are separated by a separating unit, as a result of which only one sheet is fed to the pair of transport rollers.

An example of a related feeding device is shown in FIGS. 5A and 5B. FIGS. 5A and 5B are side sectional views of the related feeding device. Of these figures, FIG. 5A shows tangent lines, one being situated at a contact point of a feeding roller and a retard roller and the other being situated at a nip point of a pair of transport rollers. On the other hand, FIG. 5B shows a state in which a sheet is fed between the feeding roller and the pair of transport rollers.

As shown in FIGS. 5A and 5B, a related feeding device includes a feeding roller 501, which is D-shaped as viewed from a side; a retard roller 508 serving as a separating unit and provided so that it can externally contact the feeding roller 501; and a pair of transport rollers 504 that transport a sheet P1 to a downstream recording section (not shown). The pair of transport rollers 504 include a transport drive roller 505, which performs driving by driving force, and a transport driven roller 506, which is driven and rotated by rotation of the transport drive roller 505).

Between the feeding roller 501 and the pair of transport rollers 504, a guide 509 that supports the bottom of the sheet P1 being fed and that guides the sheet P1 to the pair of transport rollers 504 is provided at a base side. A path top portion 503 is provided at a holder 502 side so as to oppose the guide 509.

In the related art, as shown in FIG. 5A, between a contact point 510 of the feeding roller 501 and the retard roller 508 and a nip point 511 of the pair of transport rollers 504, a first tangent line U at the contact point 510 of the feeding roller 501 and the retard roller 508 intersects a second tangent line W at the nip point 511 of the pair of transport rollers 504.

Therefore, as shown in FIG. 5B, when the sheet P1 is fed from the feeding roller 501 to the pair of transport rollers 504, the sheet P1 is bended so as to protrude towards the intersection point with respect to a line F connecting the contact point 510 and the nip point 511 and serving as a boundary. This takes place between the contact point 510 of the feeding roller 501 and the retard roller 508 and the nip point 511 of the pair of transport rollers 504. In addition, during what is called "skew removing," the sheet P1 is further bended between the contact point 510 of the feeding roller 501 and the retard roller 508 and the nip point 511 of the pair of transport rollers 504. Therefore, as shown by a chain line, a sheet P1' is bended in accordance with a shape of a receding section 512 that recedes downward or upstream and that is formed at the guide 509, which corresponds to a side of the intersection point.

However, since the guide 509 is formed so that the sheet is bended in accordance with the receding section 512 at the guide 509, for providing a bending amount during skew removing, the receding amount of the receding section 512 of the guide 509 needs to be large. When the receding amount of the receding section 512 is large, the rigidity of a base 513 may be reduced.

In addition, there is a limit as to how large the receding amount can be made while maintaining the function of guiding the sheet P1 to the pair of transport rollers 504, which is a function of the guide 509. Therefore, since the sheet P1 cannot be bended by a large bending amount, skew removing may not be satisfactorily carried out.

Further, a space at the side of the path top portion opposing the guide 509 is what is called a dead space 507.

SUMMARY

An advantage of some aspects of the invention is that it provides a feeding device, and a recording apparatus and a liquid ejecting apparatus including the feeding device, which can sufficiently bending a recording medium as a result of effectively using a space in a recording-medium feeding path between a feeding roller and a pair of transport rollers.

According to a first aspect of the invention, there is provided a feeding device including a feeding roller and a pair of transport rollers. The feeding roller picks up stacked recording medium and feeds the recording medium downstream direction. The pair of transport rollers transport the fed recording medium to a recording section. The feeding roller is provided so as to be capable of contacting a separating unit that separates the overlapped recording medium with plural. Between a contact point of the feeding roller and the separating unit and a nip point of the pair of transport rollers, a first tangent line does not intersect a second tangent line. The first tangent line is situated at the contact point of the feeding roller and the separating unit. The second tangent line is situated at the nip point of the pair of transport rollers.

According to the first aspect of the invention, between the contact point of the feeding roller and the separating unit and the nip point of the pair of transport rollers, the first tangent line at the contact point of the feeding roller and the separating unit does not intersect the second tangent line at the nip point of the pair of transport rollers. For example, it is possible to perform what is called "skew removing," so that, between the contact point of the feeding roller and the separating unit and the nip point of the pair of transport rollers, the recording medium is bended so that the sheet protrudes in the directions of the upper side (front) and the lower side (back) of the surfaces of the recording medium to be bended. Therefore, according to the first aspect of the invention, it is possible to sufficiently bending the recording medium as a result of effectively making use of a limited space. In addition, it is not necessary to provide a large receding section (512; see FIG. 5), which is a space required to bending the recording medium in only one direction in the related art. Consequently, the rigidity of a base of the feeding device is not reduced.

Further, even when skew removing is not carried out, the recording medium that is fed is bended in an S shape as viewed from a side thereof. As a result, since the recording medium is bended in both directions, it is possible to reduce curling of the recording medium in one direction.

In a first form according to the invention, prior to transporting the recording medium to the recording section, the feeding roller and the pair of transport rollers cooperate with each other, so that, between the contact point of the feeding roller and the separating unit and the nip point of the pair of transport rollers, skew removing is executed as a result of bending the recording medium.

In addition to providing the operational advantages of the first aspect, the first form according to the invention makes the following possible. That is, prior to transporting the recording medium to the recording section, the feeding roller and the pair of transport rollers cooperate with each other to bending the recording medium in an S shape, as viewed from a side thereof, between the contact point of the feeding roller and the separating unit and the nip point of the pair of transport rollers, so that skew removing is executed. Therefore, the first form is very effective when the feeding device is formed so that, skew removing, which is required to sufficiently bending the recording medium in a limited space, is executed.

Here, "skew removing" may be performed by what is called a "clinging-and-ejecting method," or what is called an "abutting method." In the "clinging-and-ejecting method," after an edge of the recording medium clings to the pair of transport rollers, the rotation of the pair of transport rollers is reversed to eject the edge, thereby bending the recording medium. In the "abutting method," an edge of the recording medium is abutted against the pair of transport rollers to bending the recording medium.

In a third form according to the invention, the feeding device further includes a first guide and a second guide. The first guide is provided at the base at the separating-unit side and guides the recording medium to the pair of transport rollers. The second guide is provided at a location opposing the first guide at the feeding-roller side, and guides the recording medium to the pair of transport rollers.

In addition to providing the same operational advantages as any one of the first aspect, the second form is such that the first guide and the second guide are provided. Therefore, the recording medium can be bended in an S shape as viewed from a side thereof while restricting the recording medium by the first guide and the second guide. That is, since the recording medium can contact the first guide and the second guide, useless space, or what is called a dead space (507; see FIG. 5), is rarely formed at whichever of the first guide and the second guide the recording medium does not contact when the recording medium only contacts either one of the first guide and the second guide.

According to a second aspect of the invention, there is provided a recording apparatus comprising a feeding section and a recording section. The feeding section picks up stacked recording medium and feeds the recording medium towards the recording section. The recording section performs a recording operation as a result of discharging ink onto the recording medium fed from the feeding section. The feeding section includes any one of the above-described feeding devices.

According the second aspect of the invention, the recording apparatus includes any one of the above-described feeding devices. Therefore, the recording apparatus can provide the operational advantages provided by any one of the above-described feeding devices.

According to a third aspect of the invention, there is provided a liquid ejecting apparatus comprising a feeding section and a liquid ejection section. The feeding section includes a feeding roller and a pair of transport rollers. The feeding roller picks up stacked liquid ejection medium and feeds the liquid ejection medium downstream direction. The pair of transport rollers transport the fed liquid ejection medium to the liquid ejection section. The liquid ejection section ejects liquid onto the liquid ejection medium fed from the feeding section. The feeding roller is provided so as to be capable of externally contacting a separating unit that separates the overlapped liquid ejection medium with plural. Between a contact point of the feeding roller and the separating unit and a nip point of the pair of transport rollers, a first tangent line does not intersect a second tangent line. The first tangent line is situated at the contact point of the feeding roller and the separating unit. The second tangent line is situated at the nip point of the pair of transport rollers.

BRIEF DESCRIPTION OF THE DRAWINGS

The invention will be described with reference to the accompanying drawings, wherein like numbers reference like elements.

DESCRIPTION OF EXEMPLARY EMBODIMENTS

A feeding device and a recording apparatus, which is an example of a liquid ejecting apparatus using the feeding device, according to embodiments of the invention of the application will hereunder be described. First, a liquid ejecting apparatus according to an embodiment of invention of the application, and, then, an ink jet printer 100, which is an example of the liquid ejecting apparatus and which is a best mode for realizing the recording apparatus, will be discussed to describe the overall schematic structure with reference to the drawings.

Figure 1:
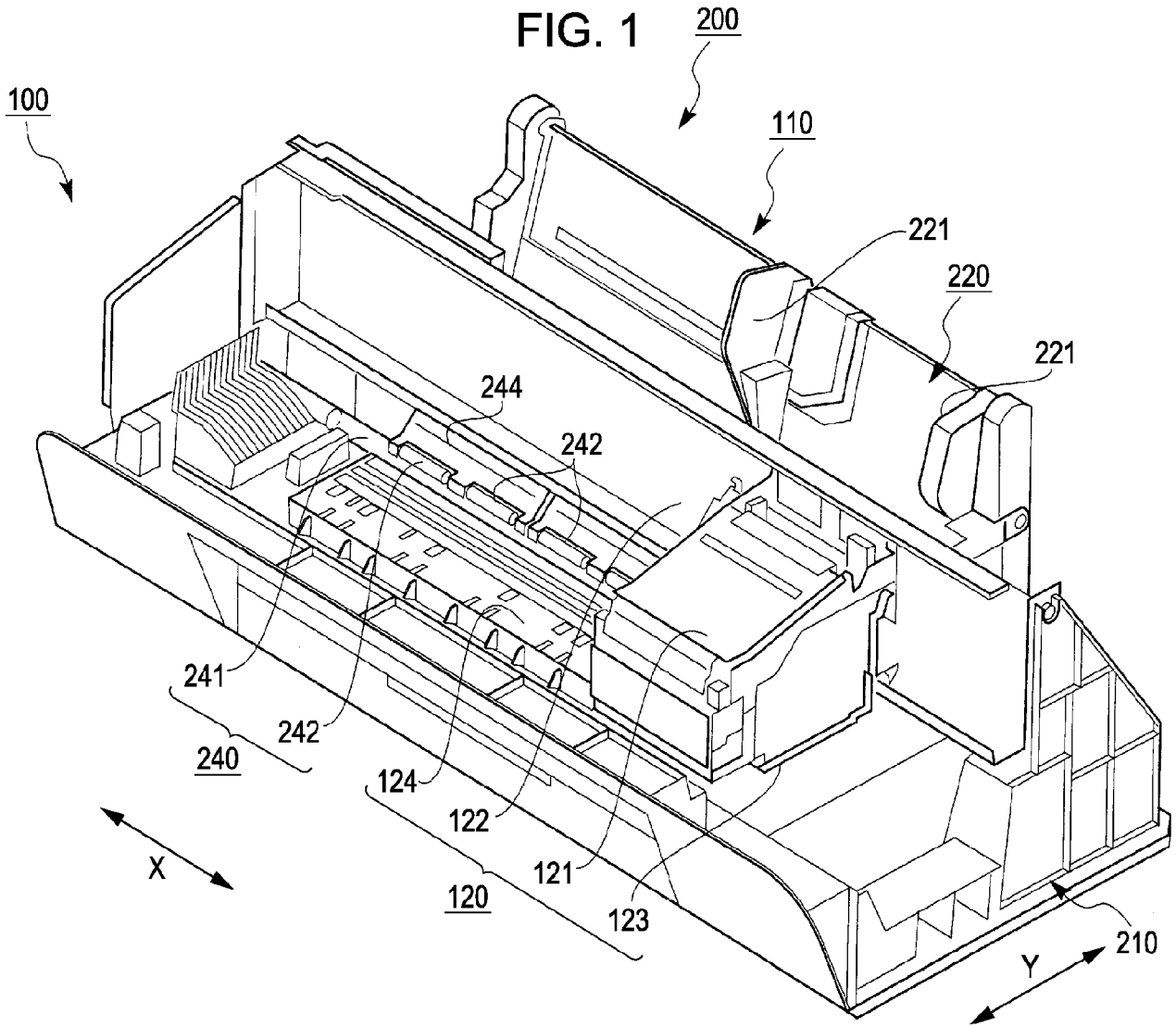
FIG. 1 is an overall perspective view of the interior of a recording apparatus according to an embodiment of the invention.
Figure 2:
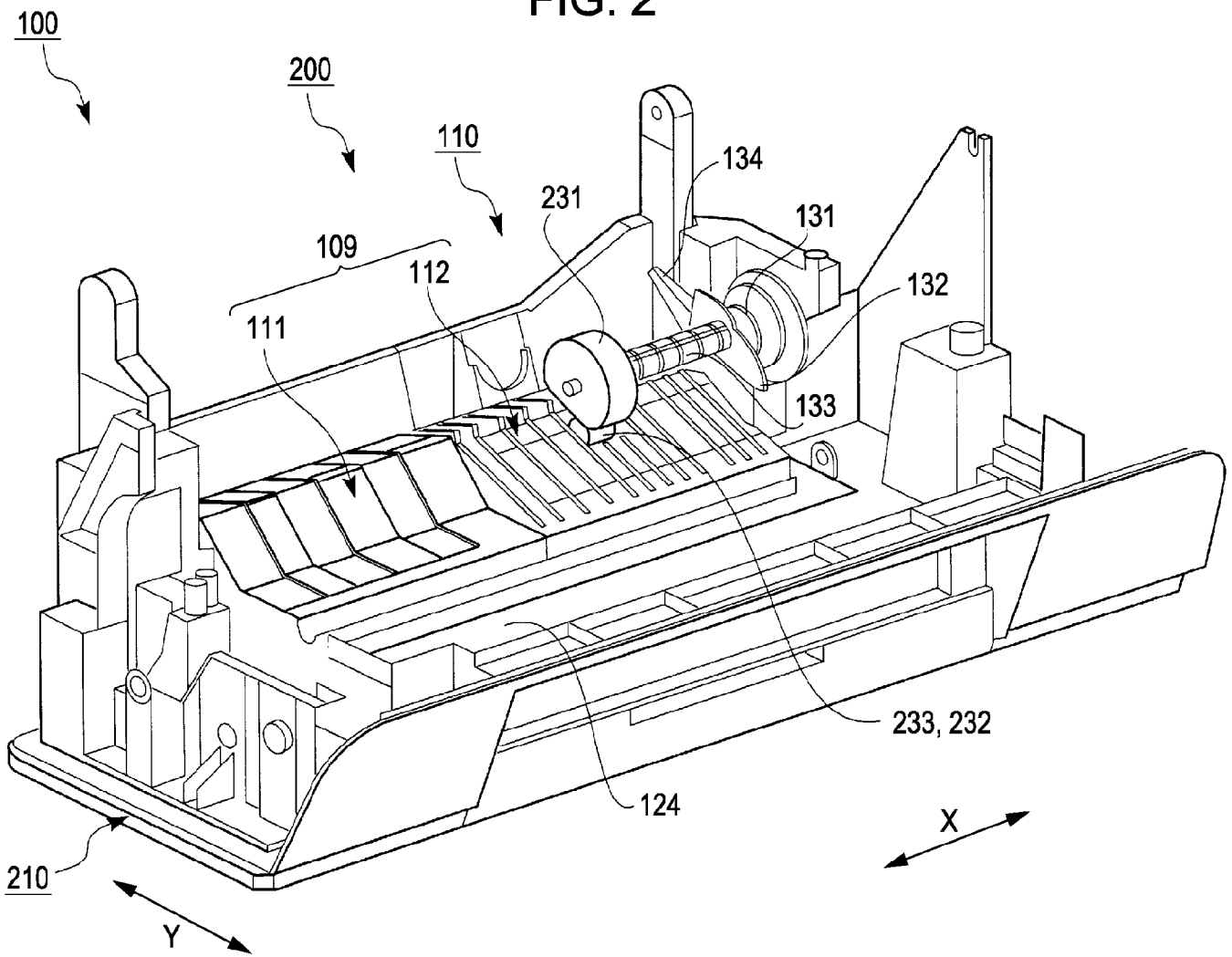
FIG. 2 is an overall perspective view of the interior of the recording apparatus shown in FIG. 1 without a recording section.

FIG. 1 is an overall perspective view of the interior of an ink jet printer according to an embodiment of the invention. FIG. 2 is an overall perspective view of the interior of the ink jet printer shown in FIG. 1 without a recording section.

As shown in FIGS. 1 and 2, the ink jet printer includes a feeding section 110 and a recording section 120. The feeding section 110 is used to feed recording medium P (hereunder simply referred to as "sheets P"), which are an example of liquid ejection medium. The recording section 120 performs recording on the sheets P fed from the feeding section 110. A feeding device 200 functioning as the feeding section 110 includes a hopper 220, a feeding roller 231, and a pair of transport rollers 240. The hopper 220 serves as a stacking section for stacking the sheets P. The feeding roller 231 is D-shaped as viewed from a side thereof and picks up the sheets P from the hopper 220. The pair of transport rollers 240 transport the sheets P fed from the feeding roller 231 to the recording section 120.

The hopper 220 is formed so that its lower portion can swing around a top portion of the back surface of the ink jet printer 100 so as to come into contact with and separate from the feeding roller 231. This top portion serves as a fulcrum. More specifically, the lower portion of the hopper 220 is biased towards the feeding roller 231 at all times by a biasing force (not shown). In addition, a supporting shaft 133, where the feeding roller 231 is provided, is provided so as to rotate by a power unit (not shown). Further, a second cam 132, provided at the supporting shaft 133, is provided so as to rotate by the rotation of the supporting shaft 133, and come into contact with the lower portion of the hopper 220 to swing the hopper 220.

Here, the sheets P are restricted in main scanning directions X by a pair of side edge restricting sections 221 and 221, which are provided at the hopper 220 in the main scanning directions X. Reference numeral Y denotes sub-scanning directions in which the sheets P are fed.

With regard to a timing in which the hopper 220 swings, when, during one rotation of the feeding roller 231 counter-clockwise in FIG. 2, a location of the feeding roller 231 facing the hopper 220 changes from a chord portion to an arc portion of a D-shaped portion, the lower portion of the hopper 220 approaches the feeding roller 231. Therefore, the topmost sheet P stacked at the hopper 220 is picked up by the feeding roller 231 and fed downstream towards the pair of transport rollers 240. Then, when the feeding roller 231 is rotated by a predetermined amount, the hopper 220 moves away from the feeding roller 231 by the second cam 132.

A retard roller 233, which is an example of a separating unit 232 and which requires a certain load for being rotated, is provided at a location of a base 210 opposing the feeding roller 231. In addition, it is provided so that the following relationships are established:

$$\|1>\mu3$$

$$\mu2>\mu3$$

where $\mu1$ is a friction coefficient between the feeding roller 231 and the sheet P, $\mu2$ is a friction coefficient between the retard roller 233 and the sheet P, and $\mu3$ is a friction force between the sheets P. Therefore, even if an "avalanche phenomenon," in which a plurality of sheets are transported into an opening 245 (see FIG. 3) near the retard roller 233 and the feeding roller 231, occurs, only one sheet P that is in contact with the feeding roller 231 is fed to the pair of transport rollers 240 by rotation of the feeding roller. The movements of the other sheets P towards the pair of transport rollers 249 are restricted by the retard roller 233.

Then, when the hopper 220 returns to its original position where it is separated from the feeding roller 231, a first cam 131, provided at the supporting shaft 133, contacts a cam follower 134. A sheet return lever (not shown) is integrally provided with the cam follower 134 so that rotation of the cam follower 134 causes the sheet return lever to rotate. In addition, the sheet return lever is provided so as to push back the sheet P that is on the verge of being excessively fed by the feeding roller 231. Therefore, the sheet that is restricted by the retard roller 233 is returned to the hopper 220 by the sheet return lever.

What is called "skew removing" is performed on the sheet P transported to the pair of transport rollers 240.

Here, the "skew removing" may be performed by what is called a "clinging-and-ejecting method," or what is called an "abutting method." In the "clinging-and-ejecting method," after an edge of the sheet P clings to the pair of transport rollers 240, the rotation of the transport rollers 240 is reversed to eject the edge, thereby bending the sheet P. In the "abutting method," an edge of the sheet P is abutted against the pair of transport rollers 240 to bending the sheet P.

The pair of transport rollers 240 include a transport drive roller 241, which performs driving by power from a power unit, and a transport driven roller 242, which rotates in accordance with the transport drive roller 241. The transport driven roller 242 is rotatably held by a holding section 244, and is biased towards the transport drive roller 241.

The sheet P is transported to the recording section 120 by the rotation of the transport drive roller 241. Recording is performed on the sheet P at the recording section 120.

The recording section 120 includes a recording head 123, a platen 124, a carriage 121, and a carriage guide 122. The recording head 123 ejects ink onto the sheet P. The platen 124 supports the lower portion of the sheet P and guides the sheet P to a location opposing the recording head 123. The carriage 121 carries the recording head 123 and moves in the main scanning directions X. The carriage guide 122 is mounted to the base 210 and guides the carriage 121 in the main scanning directions X.

When the sheet P is transported by the rotation of the transport drive roller 241, and the carriage 121 scans in the main scanning directions X, the recording head 123 ejects ink, thereby performing a recording operation.

In a sheet-P feeding path 109 of the feeding device 200, at a side towards which the sheet P whose bottom is supported is guided to the pair of transport rollers 240, a first guide 112 and a receding guide 111 are provided in the main scanning directions X. The first guide 112 is provided at a first-digit side where the feeding roller 231 is provided. The receding guide 111 is provided at an 80-digit side so as to recede downward from the first guide 112. Here, the feeding roller 231 is inclined towards the one-digit side with respect to the center of the overall width of the feeding path 109 in the main scanning directions X. Therefore, if the 80-digit side of the sheet P undergoes what is called "floating" because a holding force of the feeding roller 231 does not reach the sheet P, a portion of the feeding path 109 at the 80-digit side may be shorter than a portion of the feeding path 109 at the one-digit side. The receding guide 111 is provided so that the portion of the feeding path 109 at the 80-digit side becomes long due to the receding of the receding guide 111 from the first guide 112 in correspondence with the shortening of the feeding path 109 at the 80-digit side. Therefore, it is possible to reduce the difference between the portion of the feeding path 109 at the 80-digit side and the portion of the feeding path 109 at the one-digit side, so that it is possible to reduce the occurrence of skew removing resulting from the difference.

The 80-digit side of the supporting shaft 133 of the feeding roller 231 is supported by a bearing (not shown) provided at the back of the carriage guide 122.

Figure 3A:
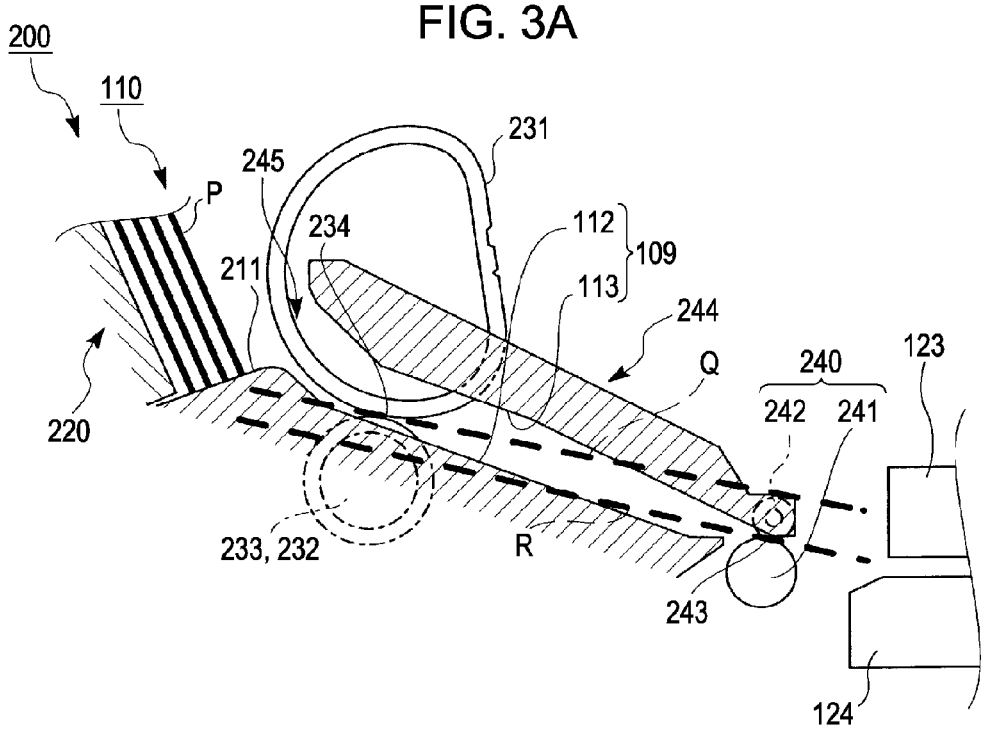
FIGS. 3A and 3B are side sectional views of a feeding path of the feeding device according to the embodiment of the invention.
Figure 3B:
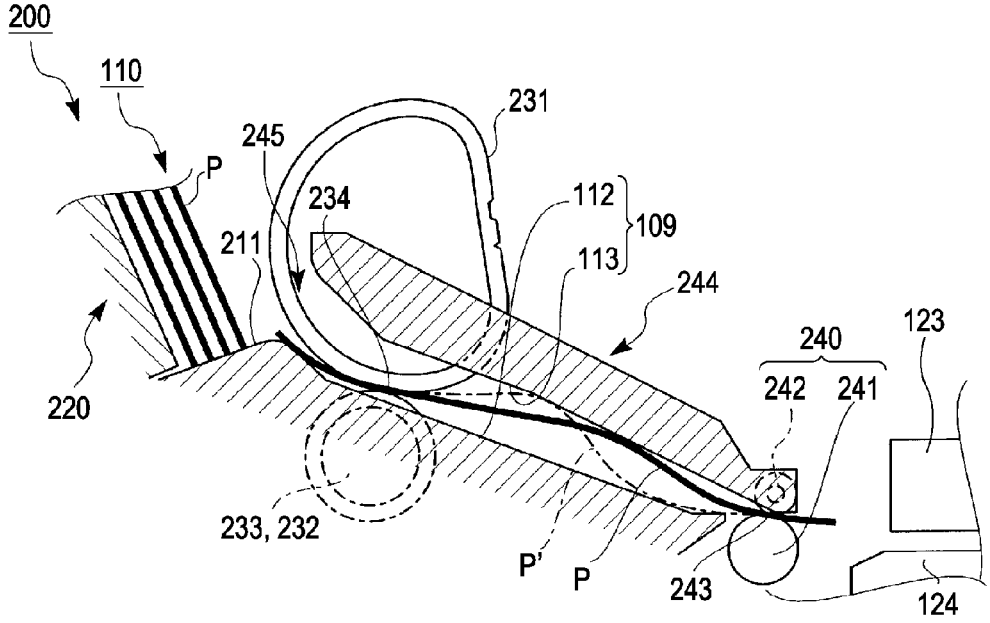

FIGS. 3A and 3B are side sectional views of the feeding path of the feeding device according to the embodiment of the invention. FIG. 3A shows tangent lines, one being situated at a contact point of the feeding roller and the retard roller and the other being situated at a nip point of the pair of transport rollers. FIG. 3B shows a state in which a sheet is fed between the feeding roller and the pair of transport rollers.

As shown in FIGS. 3A and 3B, the feeding device 200 includes the feeding path 109 where a sheet P that is picked up by the feeding roller 231 is guided towards the pair of transport rollers 240. A portion of the feeding path 109 near the feeding roller 231 at the one-digit side in the main scanning directions is defined by the first guide 112, provided at the base 210 of the feeding device 200, and a second guide 113, provided at the holder side.

As shown in FIG. 3A, a first tangent line Q, which is situated at a contact point 234 of the feeding roller 231 and the retard roller 233, is formed so as not to intersect a second tangent line R, which is situated at a nip point 243 of the pair of transport rollers 240, between the contact point 234 and the nip point 243. In addition, the first tangent line Q is formed so as to be positioned above the second tangent line R between the contact point 234 and the nip point 243.

At the upstream side of the feeding roller 231, the hopper 220, where sheets P are stacked, is provided. An edge of each sheet P is supported from below by a bank 211. When the feeding roller 231 picks up the sheet P as a result of the swinging of the hopper 220 and the rotation of the feeding roller 231, the sheet P is transported to the contact point 234 through the opening 245, which is an entrance of the feeding path 109 and which is defined by the first guide 112 and the feeding roller 231. Then, as mentioned above, the portion of the sheet that excessively enters the opening 245 is separated by the retard roller 233, and is returned to the hopper 220 by the sheet return lever (not shown).

As shown in FIG. 3B, when the sheet P is fed by the feeding roller 231 and the retard roller 233, the sheet P is pinched by the feeding roller 231 and the retard roller 233. Therefore, the orientation of the sheet P near the contact point 234 is the same as that of the first tangent line Q. When the sheet P is fed further, an edge of the sheet P comes into contact with the second guide 113. Then, the edge of the sheet P is guided by the second guide 113 and reaches the nip point 243 of the pair of transport rollers 240. When the edge of the sheet P reaches the nip point 243, the edge of the sheet P is pinched by the pair of transport rollers 240 by driving the transport drive roller 241 clockwise. Here, the orientation of the sheet P near the nip point 243 is the same as that of the second tangent line R.

Therefore, in the state in which the sheet P is pinched at two locations, that is, at the contact point 234 and the nip point 243, the sheet P is bended in an S shape, as viewed from a side thereof, between the contact point 234 and the nip point 243. At this time, skew removing is performed by what is called the "clinging-and-ejecting method." More specifically, when the pair of transport rollers 240 pinch the sheet P, that is, when the sheet P clings to the pair of transport rollers 240, the driving of the feeding roller 231 and the transport drive roller 241 is stopped. Then, while the feeding roller 231 is stopped, the transport drive roller 241 is reversely driven counterclockwise. Therefore, the pair of transport rollers 240 can eject the edge of the sheet P upstream. At this time, the sheet P is bended into an S shape by a larger amount as illustrated by reference character P' indicating a chain line, and contacts the first guide 112 and the second guide 113. Therefore, a sheet P' can be bended as a result of making effective use of a limited space. That is, a dead space is rarely formed.

An edge of the sheet P' follows what is called a "nip line," which extends in the main scanning direction X from the nip point 243. Therefore, it is possible to remove a skew. Thereafter, the feeding roller 231 and the transport drive roller 241 are driven forwardly counterclockwise to transport the skewed sheet P' downstream towards the recording section 120.

Although the skew removing method is executed by the "clinging-and-ejecting method," it may be executed by what is called the "abutting method," in which an edge of the sheet P is abutted against the pair of transport rollers 240 that are stopped. As with the case in which the "clinging-and-ejecting method" is executed, even in this case, it is possible to bending a sheet into an S shape like the sheet P' illustrated by the chain line.

Figure 5A:
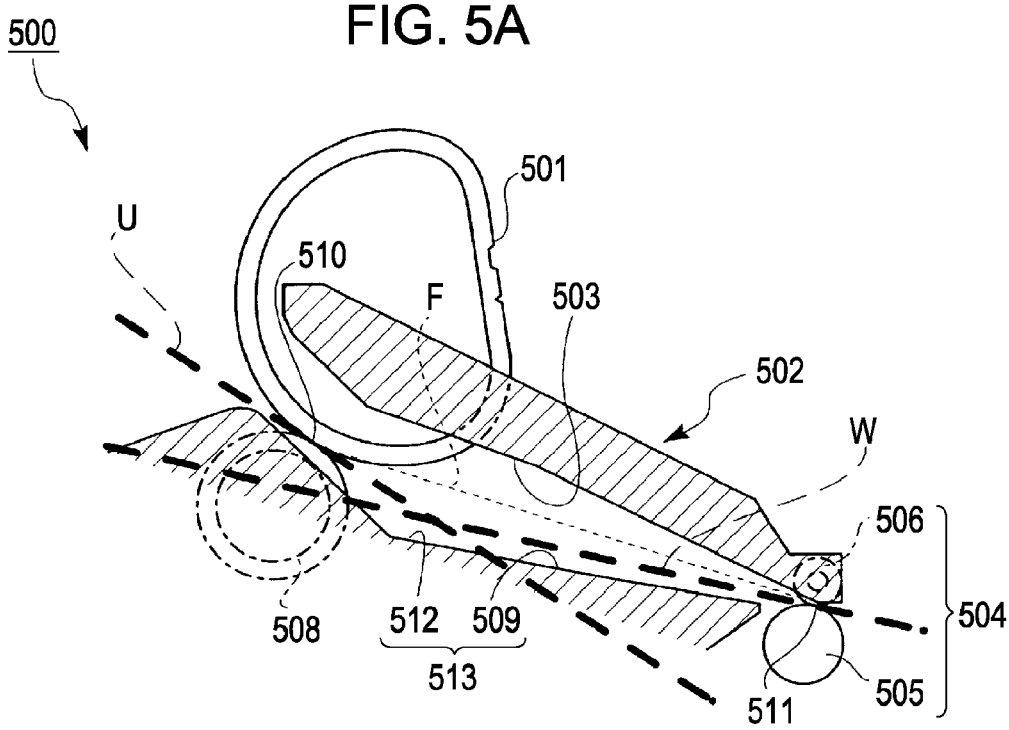
FIGS. 5A and 5B are side sectional views of a feeding path of a related feeding device.
Figure 5B:
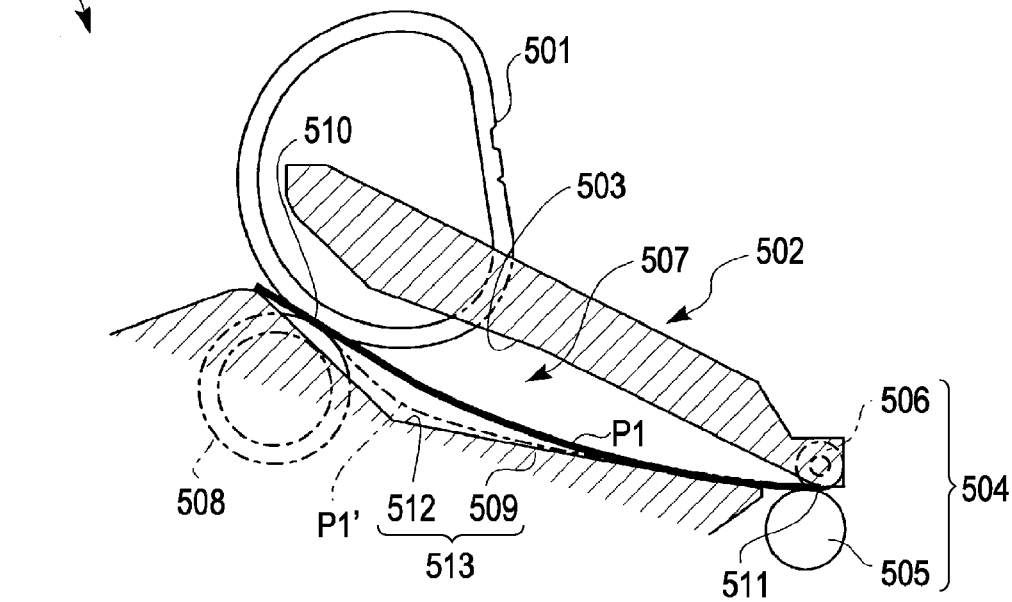

The first tangent line Q and the second tangent line R can be prevented from intersecting each other between the contact point 234 and the nip point 243 by only moving the position of the retard roller 508 downstream in the structure of the related feeding device (refer to FIGS. 5A and 5B). Therefore, as mentioned above, a sheet can be bended in an S shape without making significant changes.

The feeding device 200 according to the embodiment includes the feeding roller 231, which picks up the stacked sheets P (recording medium) and feeds the sheets P downstream, and the pair of transport rollers 240 that transport the fed sheets P to the recording section 120. In the feeding device 200, the feeding roller 231 can externally contact the retard roller 233, which corresponds to the separating unit 231 that separates the overlapped sheets P from each other immediately before the overlapped sheets P are fed. In addition, between the contact point 234 of the feeding roller 231 and the retard roller 233 (separating unit 232) and the nip point 243 of the pair of transport rollers 240, the first tangent line Q situated at the contact point 234 of the feeding roller 231 and the retard roller 233 is prevented from intersecting the second tangent line R situated at the nip point 243 of the pair of transport rollers 240.

Further, in the feeding device 200 of the embodiment, prior to transporting the sheet P to the recording section 120, the feeding roller 231 and the pair of transport rollers 240 cooperate with each other, so that, between the contact point 234 of the feeding roller 231 and the retard roller 233 (separating unit 232) and the nip point 243 of the pair of transport rollers 240, the sheet P is bended into an S shape as viewed from a side thereof, so that skewremoving is performed.

Still further, in the feeding device 200 of the embodiment, the retard roller 233 (separating unit 232) is provided at the base 210 of the feeding device 200, and the first guide 112, which guides the sheets P to the pair of transport rollers 240, is provided at the base 210 at the separating-unit side. In addition, at the position opposing the first guide 112 at the feeding-roller side, the second guide 113, which rotatably holds the transport driven roller 242 (which is a driven roller of the pair of transport rollers 240) and which guides the sheets P to the pair of transport rollers 240, is provided.

The recording apparatus 100 according to the embodiment includes the feeding section 110, which picks up the stacked sheets P and feeds them to the recording section, and the recording section 120, which performs a recording operation by discharging ink onto the sheets P fed from the feeding section. A distinctive feature of the feeding section 110 is that it includes the feeding device 200.

Other Embodiments

Figure 4A:
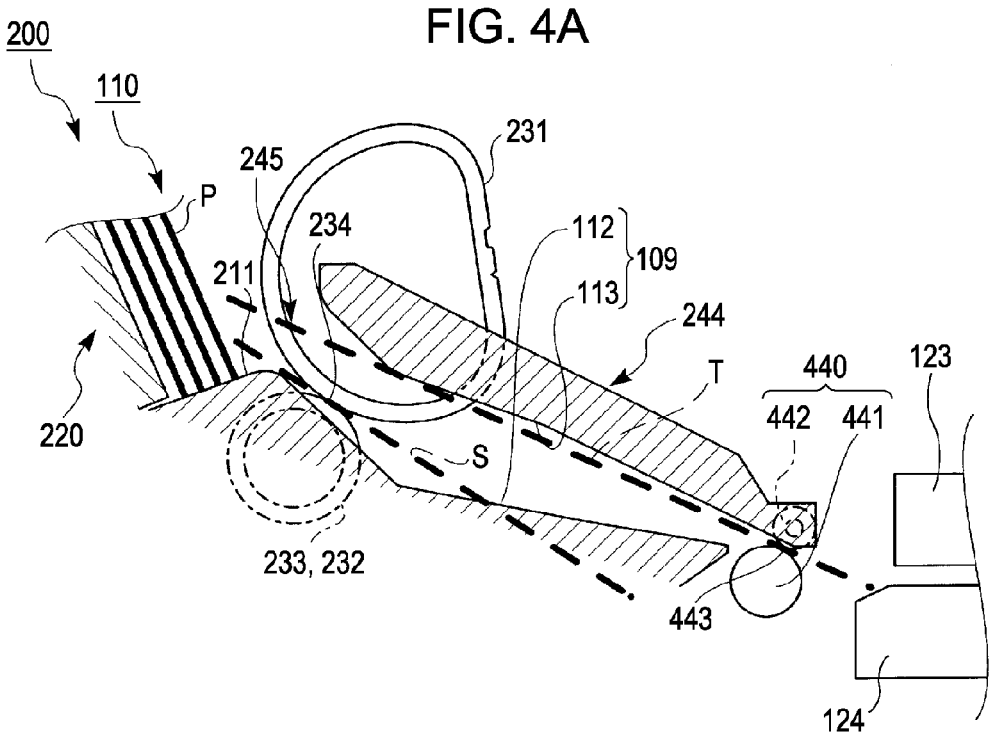
FIGS. 4A and 4B are side sectional views of a feeding path of a feeding device according to another embodiment of the invention.
Figure 4B:
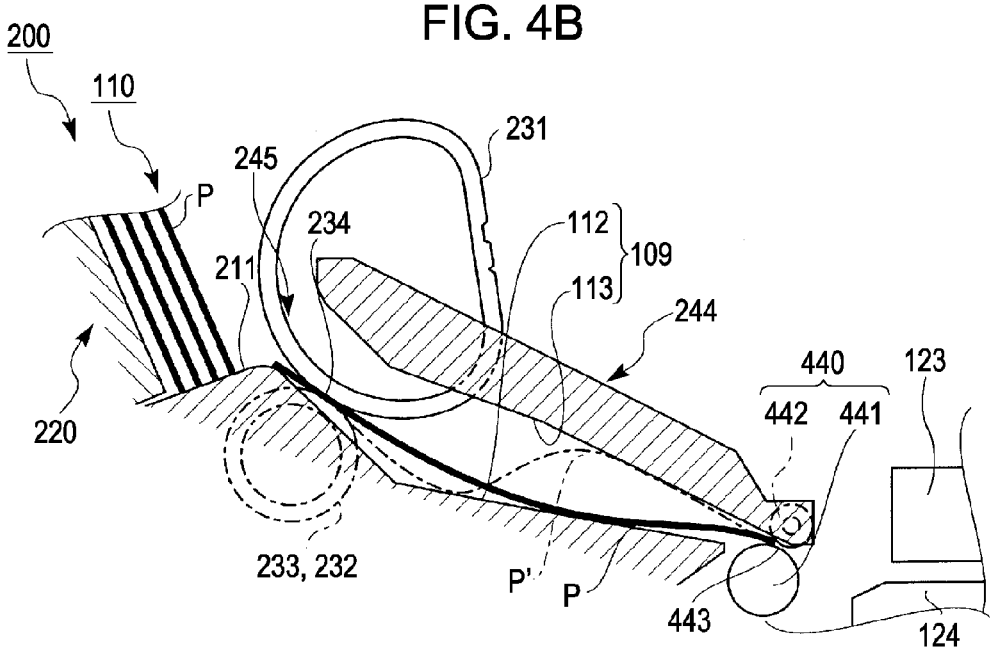

FIGS. 4A and 4B are side sectional views of a feeding path of a feeding device according to another embodiment of the invention. Of FIGS. 4A and 4B, FIG. 4A shows tangent lines, one being situated at a contact point of a feeding roller and a retard roller, and the other being situated at a nip point of a pair of transport rollers. FIG. 4B shows a state in which a sheet is fed between the feeding roller and the pair of transport rollers.

Structural features other than a first tangent line S, a second tangent line T, a pair of transport rollers 440, a transport drive roller 441, a transport driven roller 442, and a nip point 443 are substantially the same as those in the previous embodiment. Accordingly, the substantially same structural features will be given the same reference numerals, and will not be described.

As shown in FIG. 4A, the first tangent line S, situated at a contact point 234 of a feeding roller 231 and a retard roller 233, is formed so as not to intersect the second tangent line T, situated at the nip point 443 of the pair of transport rollers 440, between the contact point 234 and the nip point 443. In addition, the first tangent line S is formed so as to be positioned below the second tangent line T between the contact point 234 and the nip point 443. Further, an axis of the transport driven roller 442 of the pair of transport rollers 440 is provided so as to be positioned downstream from an axis of the transport drive roller 441 in a transportation direction.

As shown in FIG. 4B, when a sheet P is fed by the feeding roller 231 and the retard roller 233, the sheet P is pinched by the feeding roller 231 and the retard roller 233. Therefore, the orientation of the sheet P near the contact point 234 is the same as the orientation of the first tangent line S. When the sheet P is further fed, an edge of the sheet P comes into contact with a first guide 112. Then, the edge of the sheet P is guided by the first guide 112 and reaches the nip point 443 of the pair of transport rollers 440. When the edge of the sheet P reaches the nip point 443, the edge of the sheet P is pinched by the pair of transport rollers 440 by driving the transport drive roller 441 clockwise. Here, the orientation of the sheet P near the nip point 443 is the same as that of the second tangent line T.

Therefore, in the state in which the sheet P is pinched at two locations, that is, at the contact point 234 and at the nip point 443, the sheet P is bended in an S shape, as viewed from a side thereof, between the contact point 234 and the nip point 443. Then, skewremoving is performed by what is called the "clinging-and-ejecting method." At this time, the sheet P is bended into an S shape by a larger amount as illustrated by reference character P' indicating a chain line, and contacts the first guide 112 and a second guide 113. That is, the sheet P can be formed in an S shape as viewed from a side thereof by bending the sheet P so as to protrude in a direction that is opposite to the protruding direction in the embodiment shown in FIGS. 3A and 3B.

As mentioned above, the axis of the transport driven roller 442 of the pair of transport rollers 440 is provided so as to be positioned downstream from the axis of the transport drive roller 441 in the transportation direction. Therefore, when, after the skew removing, the sheet P is transported to a platen 124 of a recording section 120 to perform recording by a recording head 123, it is possible to increase the "reverse curving effect" on the sheet P by the pair of transport rollers 440 and a pair of discharge rollers (not shown) disposed downstream from the recording section. In this case, it is possible to increase the effect of preventing floating of the sheet P at the platen.

The first tangent line S and the second tangent line T can be prevented from intersecting each other between the contact point 234 and the nip point 443 by only moving the position of the transport driven roller 506 downstream in the structure of the related feeding device (refer to FIGS. 5A and 5B). Therefore, as mentioned above, a sheet can be bended in an S shape without making significant changes.

In the feeding device 200 according to another embodiment, the recording section 120 includes the recording head 123, which performs recording by discharging ink onto the sheet P, and the platen 124, which opposes the recording head 123 and which guides the sheet P. In the feeding device 200, between the contact point 234 of the feeding roller 231 and the retard roller 233 (separating unit 232) and the nip point 443 of the pair of transport rollers 440, the second tangent line T is provided closer to the recording head side than the first tangent line S in the direction in which the recording head 123 and the platen 124 are provided and oppose each other. In addition, the axis of the transport driven roller 442 (which corresponds to a first transport roller at the recording head side of the pair of transport rollers 440) is disposed downstream from the axis of the transport drive roller 441 (which corresponds to a second transport roller at the platen side) in the transportation direction.

Although, in the embodiments, the retard roller that rotates is used as a separating unit, the invention is not limited thereto, so that, obviously, a separation pad that does not rotate may also be used.

In addition, although, in the embodiments, the first transport roller is defined as the driven side and the second transport roller is defined as the drive side, it is obvious that the first transport roller may be defined as the drive side and the second transport roller may be defined as the driven side.

The invention is not limited to the above-described embodiments, so that various modifications can be made within the scope of the invention as set forth in the claims. Such modifications are obviously included within the scope of the invention.

What is claimed is:

1. A feeding device comprising:

a feeding roller that picks up stacked recording medium and feeds the recording medium in a downstream direction; and a pair of transport rollers that transport the fed recording medium to a recording section, wherein the feeding roller is provided so as to contact a separating unit that separates an uppermost recording medium from the stacked recording medium, and wherein, a first tangent line from the contact point formed between the feeding roller and the separating unit and a second tangent line formed between a nip point formed between the pair of transport rollers do not intersect each other in an area between the contact point and the nip point as viewed in plan view from a recording medium downstream direction, wherein, a feeding path is disposed downstream of the feeding roller to guide the recording medium, the feeding roller is disposed at one side deviated from the center of the feeding path in a direction perpendicular to the downstream direction, the feeding path has a first guide and a receding guide guiding the recording medium at a position receded downward with respect to the first guide, the first guide and the receding guide arranged in the direction perpendicular to the downstream direction, the first guide is disposed at the one side where the feeding roller is deviated in the direction perpendicular to the downstream direction, and the receding guide is disposed at the other side in the direction perpendicular to the downstream direction.

2. A recording apparatus comprising:

a feeding section that picks up stacked recording medium and feeds the recording medium towards a recording section; and the recording section that performs a recording operation as a result of discharging ink onto the recording medium fed from the feeding section, wherein the feeding section includes the feeding device of claim 1.

3. A liquid ejecting apparatus comprising:

a feeding section including a feeding roller and a pair of transport rollers, the feeding roller picking up stacked liquid ejection medium and feeding the liquid ejection medium in a downstream direction, the pair of transport rollers transporting the fed liquid ejection medium to a liquid ejection section; and the liquid ejection section that ejects liquid onto the liquid ejection medium fed from the feeding section, wherein the feeding roller is provided so as to externally contact a separating unit that separates an uppermost recording medium from the stacked recording medium, and wherein, a first tangent line from the contact point formed between the feeding roller and the separating unit and a second tangent line formed between a nip point formed between the pair of transport rollers do not intersect each other in an area between the contact point and the nip point as viewed in plan view from the liquid ejection medium downstream direction, wherein, a feeding path is disposed downstream of the feeding roller to guide the recording medium, the feeding roller is disposed at one side deviated from the center of the feeding path in a direction perpendicular to the downstream direction, the feeding path has a first guide and a receding guide guiding the recording medium at a position receded downward with respect to the first guide, the first guide and the receding guide arranged in the direction perpendicular to the downstream direction, the first guide is disposed at the one side where the feeding roller is deviated in the direction perpendicular to the downstream direction, and the receding guide is disposed at the other side in the direction perpendicular to the downstream direction.

* * * * *